US005933921A

United States Patent [19]

Jossi

[11] Patent Number: 5,933,921

[45] Date of Patent: Aug. 10, 1999

[54] METHOD AND DEVICE FOR IDENTIFYING THE POSITION-RELATED ORIGIN OF FOREIGN MATTER IN FIBRE BALES, IN PARTICULAR COTTON BALES

[75] Inventor: Armin Jossi, Frauenfeld, Switzerland

[73] Assignee: Jossi Holding AG, Islikon, Switzerland

[21] Appl. No.: 09/097,259

[22] Filed: Jun. 15, 1998

[30] Foreign Application Priority Data

Jul. 7, 1997 [CH] Switzerland ..... 1644/97

[51] Int. Cl.[6] ..... D01B 1/00

[52] U.S. Cl. ..... 19/80 R; 19/80 A; 19/200; 19/204; 19/205; 19/65 A

[58] Field of Search ..... 19/0.21, 65 A, 19/80 A, 80 R, 200, 204, 205; 324/226, 306; 340/679; 377/24.1; 33/710

[56] References Cited

U.S. PATENT DOCUMENTS 4,839,943 6/1989 Leifeld ..... 19/80 R

FOREIGN PATENT DOCUMENTS 414 961 8/1989 European Pat. Off. .
639 663 8/1993 European Pat. Off. .
296 04 552 5/1995 Germany .
5-025713 2/1993 Japan .

*Primary Examiner*—John J. Calvert
*Assistant Examiner*—Gary L. Welch
*Attorney, Agent, or Firm*—Shoemaker and Mattare, Ltd.

[57] ABSTRACT

The position of foreign matter in a bale pattern after its separation in a separating device (10) may be evaluated in that the relative position of the opening device (1) and the transport time of the fibers between the opening device (1) and the separating device (10) is determined in each relative position. Given a separating procedure, taking account of the mentioned variables, the position of the opening device (1) at the point in time of opening the foreign matter (28) is evaluated. The determined opening position of the foreign matter on the fiber bales (27) is stored as a signal and subsequently preferably graphically represented. The method permits conclusions on the degree of contamination of the fiber bales.

10 Claims, 4 Drawing Sheets

Figure 1:
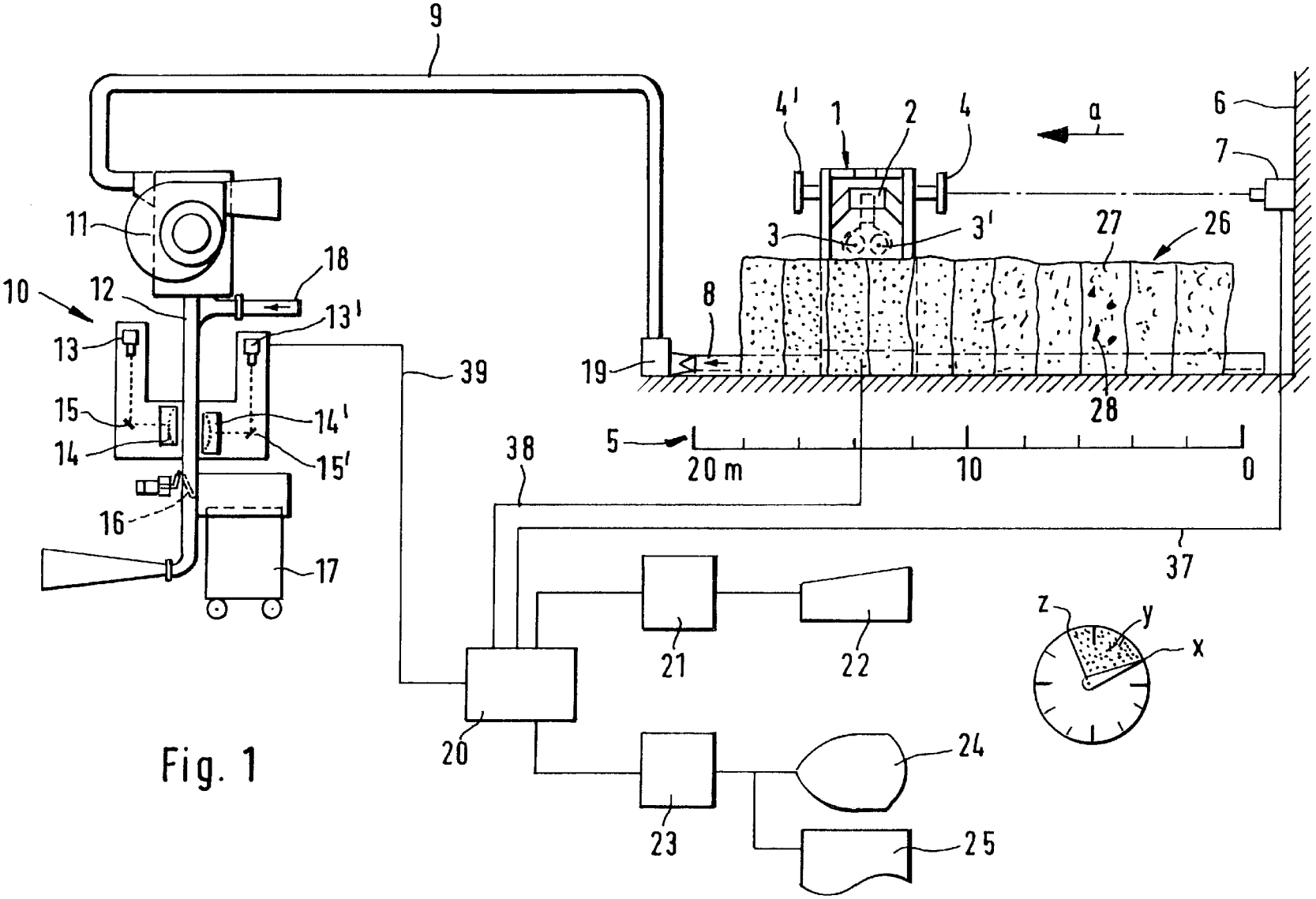

METHOD AND DEVICE FOR IDENTIFYING THE POSITION-RELATED ORIGIN OF FOREIGN MATTER IN FIBRE BALES, IN PARTICULAR COTTON BALES

The invention relates to a method and a device for the identification of the position-related origin of foreign matter in fibre bales, in particular cotton bales, after their separation. Methods and devices of this type are for example applied in the blow room of a spinning mill, where from bales of cotton with the help of an opening device, fibres or flocks are opened and led to the further processing process. Impurites contained in the fibre bales, such as e.g. plastic sheets, windings, tapes, etc. must at the same time be recognised and separated.

There are already known devices which recognise impurities directly at the bale opener. Thus for example according to EP-A412 447 the extent of impurity with foreign bodies is retained and stored in allocation to the respective bales. According to DE-39 36 079 the bale opener, on recognising a foreign body is controlled such that the impurified part is left free until it can be removed by the operating person. A disadvantage of this method lies principally in the fact that the foreign body recognition at the compressed cotton bales is not so efficient due to the compactness of the fibre material. Furthermore the recognised foreign matter must be removed in each case manually which leads to interruptions in operation.

In order to increase the efficiency of the foreign material separation there are therfore already known automised separating methods with which the loose fibre material is continuously led to a separating device and here is checked by way of sensors. Foreign matter, automatically separated from the flow of fibre stock. Such a separating device has for example become known by way of Unsolved until now however is still the problem, also with continuously functioning separating devices with a high speed of flow of fibre stock, of permitting an allocation of the separated foreign matter to the respective bales. Such an allocation would in particular allow for contaminated bales to be identified and removed from the working process, as well as in any case to refer back to the deliverer of cotton.

It is therefore the object of the invention to provide a method which also permits an identification of the position-related origin of foreign matter in fibre bales also when the opened fibres are firstly transported over a longer path to a separating device and when the recognition and separation of the foreign matter is not effected until the separation device achieved with a method which has the features of claim 1. The opened fibres are at the same time preferably pneumatically transported from the opening device to the separating device. Other transport devices such as e.g. conveyor belts would however as a rule likewise be possible. The identification of the position of foreign matter is made possible in that the relative position of the opening device on the one hand and the transport time of the fibres between the opening device and the separating device on the other hand is determined, wherein with a separating procedure, taking account of the mentioned parameters, the position of the opening device at the point in time of the opening of the foreign matter is evaluated and wherein further the determined opening position of the foreign matter at the fibre bales is stored as a signal. Evidently this results in different transfer times of the fibre material from the opening device to the separating device, according to where the opening device is actually located. By way of taking into account this transfer time, given a separating procedure the actual position of the separating device on opening the foreign matter may be evaluated. If from this evaluated position a signal is formed and stored, statistics may be provided and visually represented.

The evaluation of the transport time is, with a given transport speed, preferably carried out empirically at various reference positions of the opening device and stored in a computer, wherein on account of the reference values, by way of interpolation to each relative position there is allocated a transport time. The empirical evaluation of the transport time may e.g. be effected in that an impurity is led to a reference position of the transport device and that the time until response of the separating device is measured. Of course the transport time could be also evaluated in another way. Thus for example the distance between the opening device and the separating device with each relative position of the opening device is known. By way of the continuous measuring of the transport speed thus the transport time for each relative position may likewise be determined.

The opening device is advantageously linearly advanced in various horizontal planes over at least one bale pattern consisting of several fibre bales, wherein the relative position of the opening device with respect to the advance path and/or with respect to the horizontal plane is determined with at least one position sensor. In the blow room normally bale patterns of 20 meters or more are formed, over which the bale opener continuously travels and which after each passing adapts to a lower horizontal plane. With the help of the position sensor the machine position with respect to the linear advance path as well as also with respect to the horizontal opening plane may be identified.

Particularly advantageously, the relative position of the opening device at least with respect to the advance path is determined with a distance measuring apparatus which measures the distance of the opening device to a stationary measuring point. The distance measuring device has the advantage that it is completely independent of the machine data of the opening device. The relative position of the opening device may be determined in various spacial axes and from this data the respective position of the machine on the bale pattern may be evaluated. Of course it would also be conceivable, on account of the machine-specific control data, to evaluate the respective relative position of the opening device.

Particularly advantageously the method is applied such that the number of separating procedures for several horizontal planes with respect to the opening position of the foreign matter is determined and preferably represented as a diagram. Thus for example bales contaminated with numerous foreign matter may already be identified and separated after a few horizontal passages of the bale opener.

The invention also relates to a device for identifying the position-related origin of foreign matter in one or in several fibre bales. The functional features have already been mentioned in the context of the method.

With the distance measuring apparatus particularly advantageously the case of a stationary laser measuring device which is aligned to an axis of reflection arranged on the opening device. Such distance measuring apparatus are known from other technical fields e.g. from land measurement, and with these distances may be very precisely determined. Only a reflector needs to be arranged on the opening device so that also existing installations may be converted according to the invention particularly simply. Of course the position of the opening device may also be determined in another way. A distance measurement by way of infrared light, ultrasound, mechanically with the help of a pull cable or via an incremental measuring system would also be conceivable.

Of course the device may be applied to all bale opening installations known in the blow room. Thus several working regions separated from one another may be allocated to an opening device wherein at each working region a signal for identifying the working region can be produced. However also several opening devices may be connected to the same separating device, in each case via a transport device, wherein on each opening device a signal for identifying the respectively operating opening device can be produced.

Figure 2:
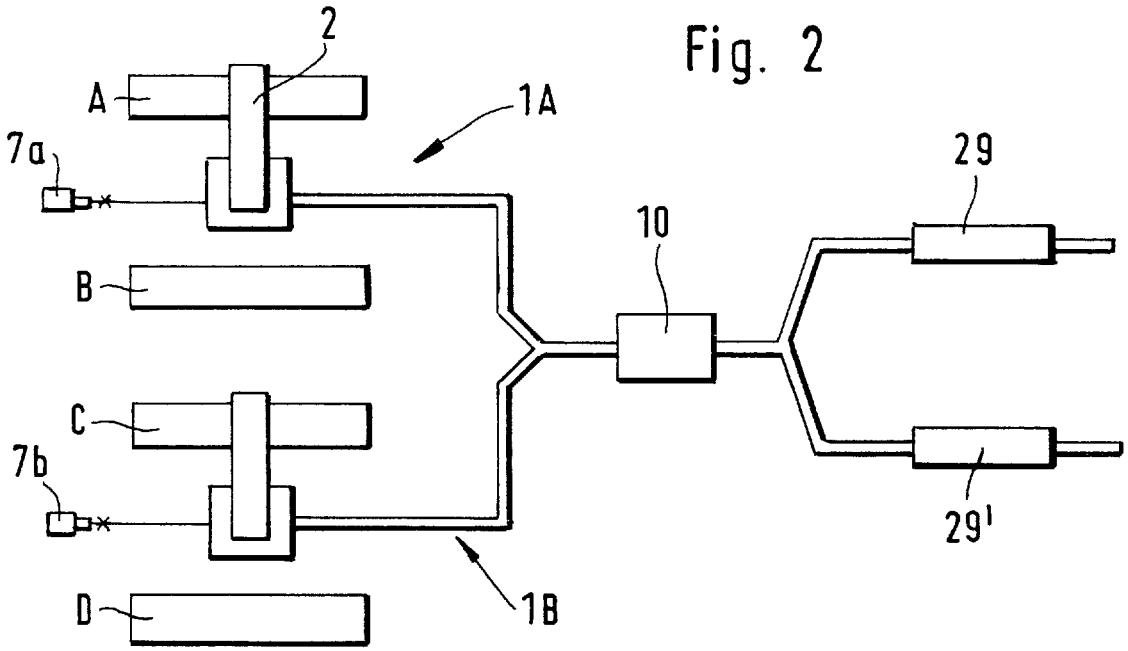
Figure 3:
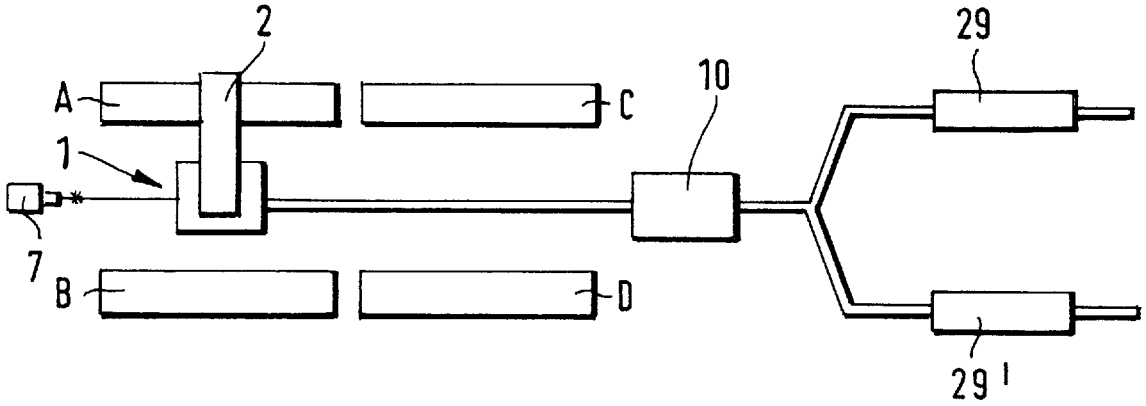
Figure 4:
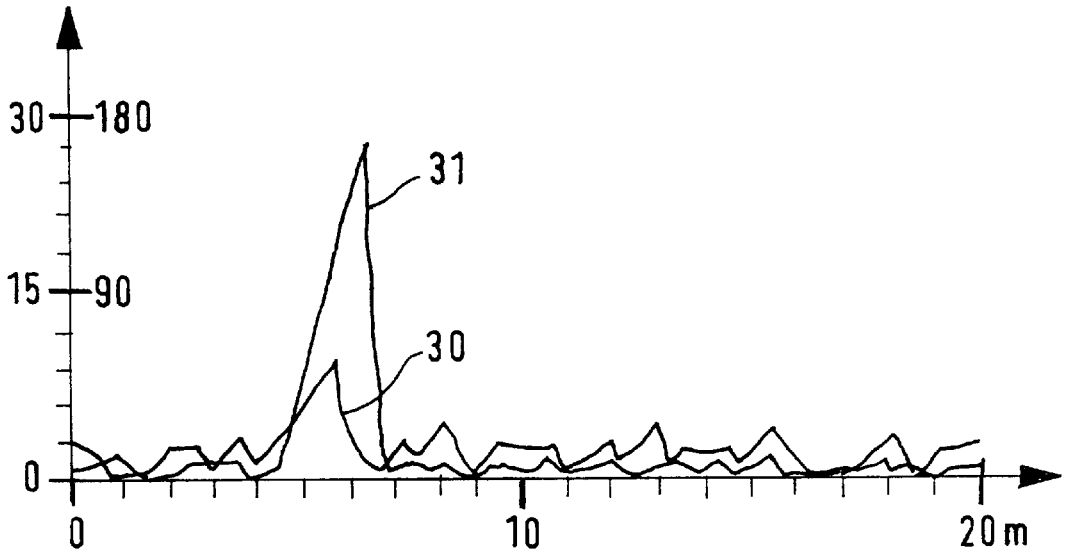
Figure 5:
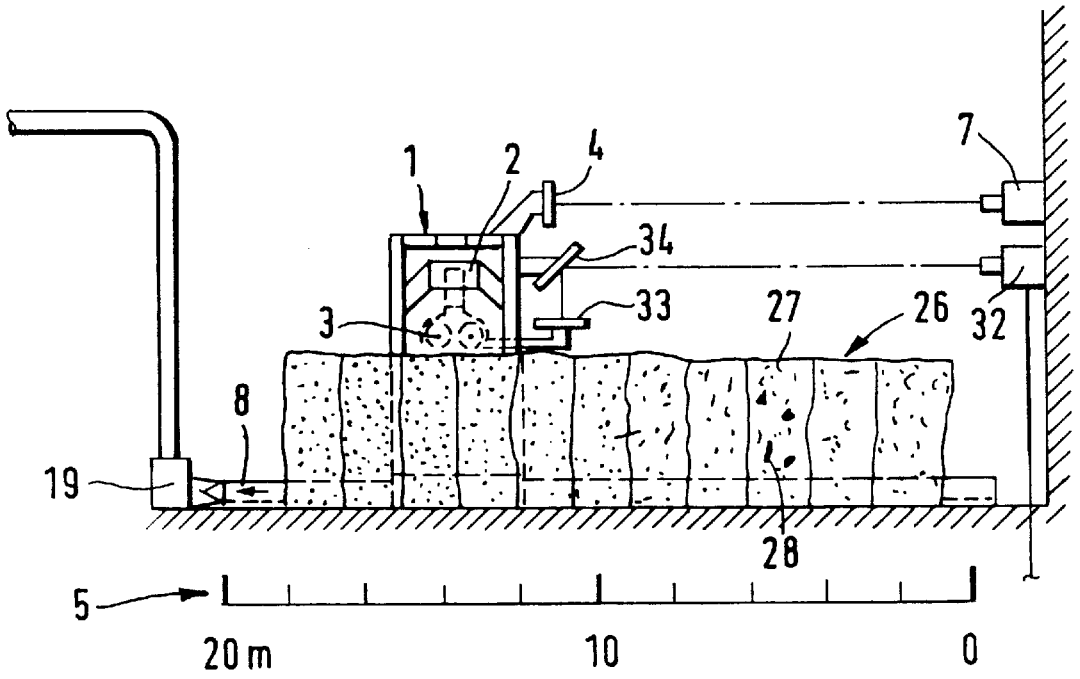
Figure 6:
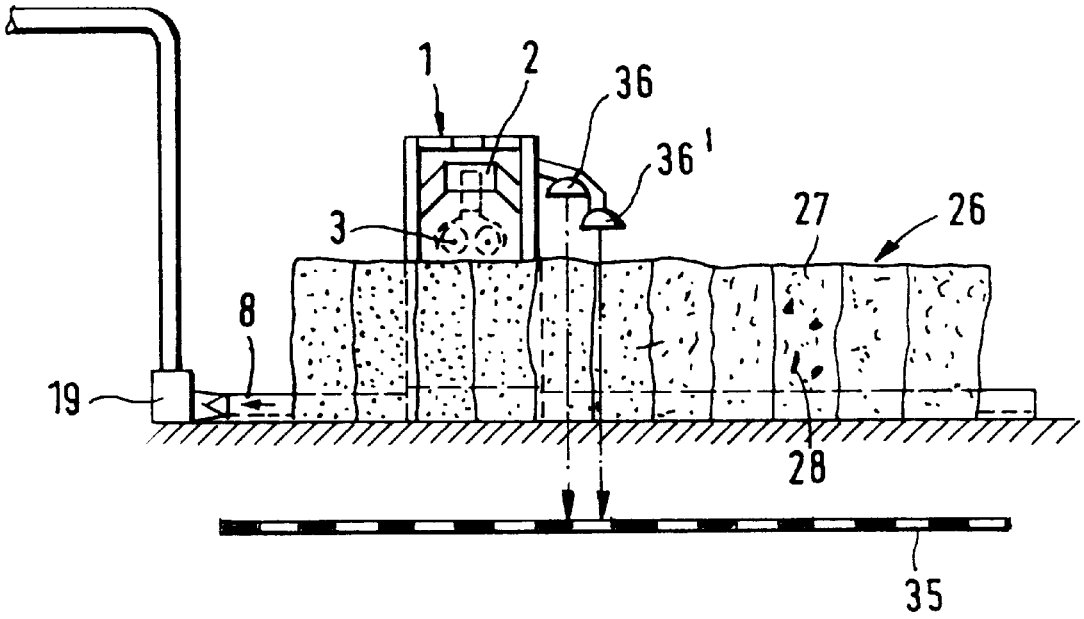

Embodiment examples of the invention are represented in the drawings and are hereinafter described in more detail. There are shown:

FIG. 1 a schematic representation of a installation according to the invention with an opening device and a separating device, in a heavily simplified lateral view, FIG. 2 a plan view of a installation with two double-sided functioning opening devices, FIG. 3 a plan view of a double-sided functioning opening device with various working regions, FIG. 4 a diagram with the representation of the inpurity of a bale pattern, FIG. 5 a modified embodiment example of an opening device with an additional measurement of the horizontal plane, and FIG. 6 a further embodiment example of an opening device with an incremental length measuring system.

As is shown in FIG. 1 an opening device 1 known per se may be displaced forward on a forward displacing path 5 over a bale pattern 26 consisting of several individual bales 27. The opening device has at its disposal an extension arm 2 on which opening rollers 3, 3' are arranged for opening the cotton fibres. The details of such an opening device are known to the man skilled in the art and are therefore not described in any detail here.

The opened fibres are led to a transport channel 8 which extends over the whole advance path 5. By way of conveying means which are not shown here the fibres via a connection location 19 go in a further transport channel 9 to the separating device 10.

The advance path 5 has for example a distance of 20 meters. The relative position of the opening device 1 and thus the position on the advance path 5 is continuously measured by way of a distance measuring apparatus 7. With this it is the case of a laser measuring apparatus which is arranged rigidly on the wall 6 and which is directed onto a reflector 4 on the opening device 1. The reflector 4' serves the position measurement with the extension arm pivoted about 180° on working off a second bale pattern. The measuring apparatus 7 delivers its data via a position data lead 37 to a computer 20. At the same time the opening device 1 may also input data specific to the machine via a machine data lead 38 to the computer 20. This data concerns the operating condition of the opening device, in particular with a pivotable extension arm 2 for the double-sided operation, also the rotational position or orientation of the extension arm.

The separating device 10 already known from WO96/35831 on the input side is provided with a condenser 11 on which the fibres are separated from the transport air. From the condenser the fibres reach into a presentation channel 12 where in a loose form they pass a sensor field. Via an air feed 18 the transport of fibres in the presentation channel 12 is supported. At the sensor field the fibres are illuminated by illumination bodies 14, 14' and from both sides are in each case impinged by a line camera 13, 13' via deflection mirrors 15, 15'. Below the sensor field there is arranged a separating flap 16 which on determining foreign matter deflects the contaminated flow of fibre stock into a collecting container 17. The determined separating procedures are led via a separating data lead 39 likewise to the computer 20.

The computer 20 has at its disposal an auxiliary memory 21 which via a data input 22 may be loaded with machine-specific data of the opening device and of the separating device. In particular here empirically determined transport times between the opening device and the separating device may be inputted which the computer then for example linearly interpolates.

On account of the previously empirically determined or where appropriate also continuously measured transfer times y the computer 20 for each announced actual position of the opening device 1 at a certain point in time x evaluates the opening position at the point in time z=x−y. By way of a separation procedure such an opening position is stored as a position value.

The computer 20 functions according to the principle of a shift register, since it must only store the announced position data so long as the longest possible transport time lasts.

The computer finally also still has at its disposal a memory 23 for storing the determined opening position on separating foreign matter 28. The data collected in the memory 23 may be observed on a screen 24 and/or be printed in any form on a printer 25.

On operation of the installation the opening device for example moves in the direction of the arrow a, wherein the opening rollers 3, 3' comb the whole bale pattern 26 and open flocks. Evidently at the same time the transport distance between the opening device 1 and the separating device 10 is reduced and thus also the transfer time of the opened fibres or foreign matter. A certain transfer time can be allocated to each relative position of the opening device 1 along the advance path 5. The actual relative position at the point in time of the separation is determined via the distance measuring apparatus 7 and from the so gained data in the computer 20 given a separating procedure, the position of the opening device at the point in time of the opening is evaluated.

The FIGS. 2 and 3 illustrate arrangements as are often the case in a blow room. According to FIG. 2 two opening devices 1A and 1B operate parallel next to one another. The extension arm 2 of each device can be applied double-sided wherein the opening device 1A works off the working regions A and B and the opening device 1B works off the working regions C and D. To each opening device there is allocated a separate distance measuring apparatus 7*a* and 7*b*. Both opening devices however lead the opened fibres to a common separating device 10. The computer 20 according to FIG. 1 thus requires in each case yet an additional signal, which on the one hand identifies the opening device and on the other hand the processed region.

From the separating device 10 the fibres freed from the foreign matter are led further to mixers 29, 29'. The separating device 10 must be arranged before the mixers since otherwise the following up of the position of foreign matter is practically no longer possible.

The installation according to FIG. 3 operates with only one opening device 1, whose extension arms 2 may however comb the working regions A, B, C, D. Also here the computer requires a signal for identifying the respective working region. With the installation according to FIG. 2 as well as also with the installation according to FIG. 3 one may change from one working region to the other as often as possible. The statistical data required for this are automatically formed from the beginning of operation and the end of operation, as well as from the corresponding signal of the working region.

In FIG. 4 the position of the determined foreign matter is represented in a diagram. On the abscissa the relative position of foreign matter with respect to the advance path between 0 and 20 meters is plotted. The ordinate shows the number of detected separations and specifically for example on the left scale for example after approx. 6 hrs. and on the right scale for example after 24 hrs. The first curve 30 is allocated to the left scale and already clearly shows a certain location of the bale pattern between 5 and 6 meters which is heavily contaminated. In FIG. 1 this corresponds to the bale 27 with numerous foreign matter 28, which then is opened with each passage of the bale opener. Already after recognition of the first curve 30 the monitoring person may decide to remove the corresponding bale from the bale pattern in order not to contaminate the production line unnecessarily with impure material.

The second curve 31 in FIG. 4 is allocated to the right scale and shows with a high accuracy the extreme contamination of the bale concerned after approx. 24 hrs. operation of the opening device. At this location about 180 separations have been registered in contrast to significantly less separations in the other regions of the advance path.

Should the device be designed in each case to determine also the horizontal plane of foreign matter this relative position may also be represented in a further diagram. Thus for example conclusions may be drawn on the cause of a contamination if a contamination on the bale pattern is always ascertained in an outer layer. Of course the provenance and arrangement of the bales of a certain bale pattern must be drawn up by the operating personnel so that later any conclusions at all are possible with individual bales.

FIG. 5 shows an alternative embodiment example of an opening device, with which not only the relative position with respect to the forward displacing path 5, but also with respect to the horizontal plane can be determined by way of a distance measurement. The relative position on the advance path 5 is evaluated via the distance measuring apparatus 7 as with the embodiment example according to FIG. 1. On the vertically displaceable extension arm 2 there is however arranged a second reflector 33. This reflects the measuring beam of a second distance measuring apparatus 32 via a deflecting mirror 34. The deeper the extension arm 2 is sunk, the larger is evidently the measuring distance at the second measuring apparatus 32. Together with the signal of the first distance measuring apparatus 7 at the same time the relative position of the extension arm 2 with respect to the horizontal plane may be evaluated. Of course it would be conceivable to directly arrange the distance measuring apparatus on the opening device and for this to place the reflectors in a stationary manner. The distance measuring apparatus at the same time however require their own cable guide on the machine and there is the increased risk of contamination.

FIG. 6 finally shows yet a further alternative of a position measurement. The opening device 1 is at the same time provided with two switching sensors 36, 36' which optically scan an incremental scale 35 on the advance path. This incremental scale could for example be painted on the floor, wherein the individual increments could be several centimeters wide. Other measurement transducers, inductive sensors or likewise are however of course conceivable. The relative position on the advance path may for example be measured with a pull cable which is coupled to the opening device 1. An essential aspect with the measuring device in any case lies in the fact that it functions completely independently of the control of the bale opener, since the position data specific to the opener are often not accessible. An autonomous measuring system may thus be applied to each and any opening device even if the specific operating data thereof cannot be accessed.

I claim:

1. A method for identifying the position-related origin of foreign matter (28) in fibre bales after separation, with which from at least one bale pattern (26) consisting of several fibre bales (27) opened by an opening device (1) moved relative to the bale pattern, fibres are opened and led via a transport device (8, 9) to a separating device (10) for separating foreign matter, determining a relative position of the opening device (1) and the transport time of the fibres between the opening device (1) and the separating device (10), wherein with a separating procedure evaluating the position of the opening device (1) at the point in time of opening of the foreign matter taking into account the time and position parameters (28) and storing the determined opening position of the foreign matter on the bale pattern as a signal.

2. A method according to claim 1,further comprising empirically determining the transport time with a given transport speed at various reference positions of the opening device (1) and storing in a computer (20) and allocating reference values and by interpolation, a transport time to each relative position.

3. A method according to claim 1,further comprising is linearly advancing the opening device over the bale pattern (26) on various horizontal planes and determining the relative position of the opening device with respect to either or both of an advance path (5) the horizontal plane by use of at least one position sensor.

4. A method according to claim 3, further comprising determining the relative position of the opening device (1) with respect to the advance path (5) by use of a distance measuring apparatus (7) which measures the distance of the opening device to a stationary measuring point.

5. A method according to claim 3 further comprising determining the number of separation procedures for several horizontal planes with respect to the opening position of the foreign matter and representing the determined information as a diagram.

6. A device for indentifying the position-related origin of foreign matter (28) in fibre bales after their separation, an opening device (1) movable relative to the fibre bales for opening fibres, a separating device (10) for separating sensorically determined foreign matter (28) in the fibres, transport device (8,9) for transporting of the opened fibres as a flow of fibre stock to the separating device (10) from the opening device, at least one position sensor positioned relative to the opening device (7) for determining the relative position of the opening device (1), a computer in communication with the position sensor (20) for evaluating the relative position of the opening device (1) given a separating procedure and for taking into account the transport time between opening and separating the foreign matter (28), and a data memory associated with the computer (23) for storing the evaluated opening position.

7. A device according to claim 6, characterised in that the opening device (1) is linearly advancable over a bale pattern (26) on various horizontal planes and that the position sensor (7) is a distance measuring apparatus with which the distance of the opening device to a stationary measuring point at least with respect to the linear advance path (5) can be measured.

8. A device according to claim 7, characterised in that the distance measuring apparatus (7) is a stationary measuring apparatus which is directed onto a reflection surface arranged on the opening device (1).

9. A device according to claim 7, characterised in that several working regions (A,B,C,D) separated from one another are allocated to an opening device (1) and that at each working region a signal is prpducible for identifying the working region.

10. A device according to one of the claims 7, characterised in that several opening devices (1A, 1B) are connected to the same separation device (10) via an individual transport device and that on each opening device a signal for identifying the opening device is producible.

* * * * *